US007918711B2

(12) United States Patent
Yeung

(10) Patent No.: US 7,918,711 B2
(45) Date of Patent: Apr. 5, 2011

(54) ROUGHNESS INSULATED SOFT CLOTHING CONNECTOR SYSTEM

(75) Inventor: Kam Yuen Ricky Yeung, Hong Kong (CN)

(73) Assignee: LEADTHEWAY Hook & Eye Tape Limited (Hong Kong Limited Company), Kwai Chung, N.T. Hong Kong (CN)

( * ) Notice: Subject to any disclaimer, the term of this patent is extended or adjusted under 35 U.S.C. 154(b) by 426 days.

(21) Appl. No.: 12/156,819

(22) Filed: Jun. 4, 2008

(65) Prior Publication Data

US 2009/0300824 A1 Dec. 10, 2009

(51) Int. Cl.
*A41C 3/00* (2006.01)

(52) U.S. Cl. .... 450/58; 24/697.1; 24/592.1; 24/DIG. 43

(58) Field of Classification Search ..... 2/96, 251–252, 2/257, 259, 263, 264, 336, 338; 450/86, 450/58, 88, 63, 64, 71, 73, 79, 82; 24/697.1, 24/697.2, 592.1, DIG. 43, 49
See application file for complete search history.

(56) References Cited

U.S. PATENT DOCUMENTS

| | | | | |
|---|---|---|---|---|
| 2,802,215 | A * | 8/1957 | Alfandre | 112/407 |
| 2,861,276 | A * | 11/1958 | Alfandre | 112/407 |
| 6,309,489 | B1 * | 10/2001 | Fildan et al. | 156/73.3 |
| 6,520,832 | B2 * | 2/2003 | Devita et al. | 450/1 |
| 7,086,925 | B2 * | 8/2006 | Kaye et al. | 450/58 |
| 2008/0295302 | A1 | 12/2008 | Senn | |

FOREIGN PATENT DOCUMENTS

EP 1776023 A1 2/2006

OTHER PUBLICATIONS

WO0191592 entitled "Connector Element For End Sections Of Pieces Clothing To Be Connected." Dec. 2001.

* cited by examiner

*Primary Examiner* — Gloria Hale
(74) *Attorney, Agent, or Firm* — Curtis L. Harrington; Kathy E. Harrington; Harrington & Harrington

(57) ABSTRACT

A clothing connector having tensile components is formed in any of the conventional ways, and a soft roughness insulating covering layer is attached to one side and then moved to the other side in an inside-out process which provides a soft finish not only to the side to which it was moved, but also the peripheral edges and a narrow portion of the side of the clothing connector to which it was originally attached. This structure and process enables quick application of a softening, object insulating covering to any clothing connector expected to face the body.

15 Claims, 2 Drawing Sheets

21
23
25
27
31
33
35
37
39
41
43
45
47
49
51
53
55
57
59
71
73
75
91
93
95
97
99
101
103
105
107
109
111

ROUGHNESS INSULATED SOFT CLOTHING CONNECTOR SYSTEM

BACKGROUND OF THE INVENTION

This invention relates to a method and technique for attachment of a roughness insulating soft layer to a clothing connector to enable roughness insulation of a main side, and edges adjacent the side from which the roughness insulating soft layer was attached.

BACKGROUND OF THE INVENTION

Clothing having connectors, support structure, and supported components take special steps and structures for consistency with the clothing. Consistency can be measured by adequate support, adequate securement and a configuration to distributively garner and lend support. Tradeoffs are made all the time, with structures bearing significant force having to be adequately sewn in a manner that helps compensate for the strength of the supported component versus the strength of the cloth which supports it. In many cases, the provision of supported structures requires significant sewing, bolting, stapling or the addition of other structures to the cloth. Such other structures may be sharp, protrusive, rough, unsightly, extremely uncomfortable. Any supplemental structures which can reduce such sharpness, protrusion, roughness, unsightliness and discomfort, and can perform such reduction in an efficient manner are highly desired.

However, building in softness and wear resistant layers over any clothing connector component can be very expensive, labor intensive and time consuming. Building up layers can require fixation which can further cause sharpness, protrusion, roughness, unsightliness and discomfort. As a result, the technique of building on layers from the outside and directly onto the side which is sought to be softened, is very difficult and requires a labor intensive manual operation with a requirement for close inspection.

SUMMARY OF THE INVENTION

A clothing connector having tensile components is formed in any of the conventional ways. Most of the conventional ways involve considerable sewing, gluing, welding and other methods to achieve a component with the desired shape and connector characteristics. Then, a soft planar material is attached in a position covering the connectors or other structure which would be facing away from the user when the clothing connector would be in a position to be worn. The soft planar material is attached near the periphery of the clothing connector with some small portion remaining unconnected.

The soft planar material may be preferably attached somewhat inboard of the outermost edge of the connector portion, and in such a way that if the resulting clothing connector piece and soft planar material is turned inside out, that the soft planar material covers to the full extent possible the outer edges of the clothing connector piece adjacent the length of attachment. The resulting structure is covered by the soft planar material at a main extent which would otherwise contact the user, as well as the edges of the connector portion covered by the soft planar material. The result is also that the outwardly projecting edges of the hook & Eye Tape is covered by the soft fabric. Original Hook & Eye tape may have used ultrasonic cut/seal using stitching to attached all the layers. The edge provided by ultrasonic seal is quite sharp (and not comfortable), and if using stitching, the edge may not perfect—some little thread at edge, but the invention will cover and help overcome the shortcomings of any type of binding technique. Therefore covering the edge can provide better edge to the hook & Eye Tape.

Where the clothing connector is a tensile connector, such as a main bra strap having multiple metal loop connectors for selectable lateral displacement connection with a metal hook connector, the main bra strap connector can be formed in a variety of ways. For example, a width of material of sufficient magnitude width to form several multiple metal loop connectors can be formed by providing several very long folds of cloth into which the multiple metal loop connectors may be sewn, typically with a spacing which will result in two metal loops or "eyes" per main bra strap connector. The very long folds will create a wide length from which multiple connectors can be formed by cutting or welding or melting, to name a few separation techniques. Once formed and stabilized by sewing, gluing, welding, or the like, the expanse of material is cut along its short length to form a multiple number of main bra strap connectors. In some instances this cutting can be by two way tricot seal-cutting, which laterally seals the multiple folded cloth members, each of which may be fitted with two or three evenly spaced apart eye loop engagement members.

The result of this operation is a clothing connector which may have a rough surface on the side opposite the eyes, as well as rough edges. Where the seal cutting is accompanied by heat, some of the material may melt and leave sharp edges during processing. Further, the sealing along the opposite edges where cuts were made may also have rough edges. Supplemental sewing or preparation or fixation can occur just before cutting or just after cutting and may occur independently of the attachment of the soft layer of material. In some clothing connector structures a wide variety of other structures may be left in place for further processing. Other processing may be done before or after cutting. Other processing may be done prior to attachment of the soft layer or after.

A soft layer of material is next attached against the access face of the clothing connector. By access face it is meant the side of the clothing connector which will need to be accessed later for connection purposes after all of the processing is complete. The soft layer of material will preferably be able to be stretched as it will be attached just inward of the outer periphery of the clothing connector, and yet the width of material between two attachment points will be required to stretch sufficiently to cover the outer edges and the complete back width of the clothing connector, in this case the clothing connector being a main bra strap eyelet or eye loop connector.

The attachment of the soft layer can be by welding, sewing, and particularly by zig zag sewing. The extent of sewing will depend upon the ability to turn any pocket formed by such sewing, "inside out" to reverse the formed pocket structure, enable the soft material to cover the side opposite the access face, as well as the edges along the sides adjacent the line or points of attachment of the soft layer.

When the main bra strap connector is in place, the soft layer will lie against the user's body or underwear, while the engagement loops or eye loops or eyelets will face away from the user. A male or hook connector will extend over the engagement loops and facing the user, but may generally have a lesser area, either vertically or by longitudinal extent and will be both held away from the body and will be prevented from touching the body by resting on the main bra strap connector made in accord with the present invention. A further advantage of the invention is the provision of a seamless back. Originally, and traditionally, Hook & Eye tape structures have visible seam at the back which can be viewed through clothing and the like. The invention provides a layer which is turned inside out and covers the back, any visual stitching or other visual anomalies will be covered.

However, at the end of the process steps described herein, the result will be, in the case where a clothing connector is a main bra strap connector, at minimum a finished hook & eye tape member which can be further sold and employed on a variety of clothing structures, including a main bra strap connector.

The ability to selectively use seal-cutting (ultrasonic) versus shear cutting will depend upon the materials selected. The types of fabric used is not particularly limited, and tricot fabric may be used. Further, although a hook & eye tape structure is described which is formed from a series of sewn layers, the utilization of the soft protective material of this invention might make possible a molded eye tape which can be covered in a soft reversible fabric and then reversed to an inside-out position. In addition, folding with any structure is expected to occur with a combination of stretching of the soft cover layer combined with some contortion of the other layer, such as an eye-loop layer to which it is attached.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figures 1, 2, 3, 4:
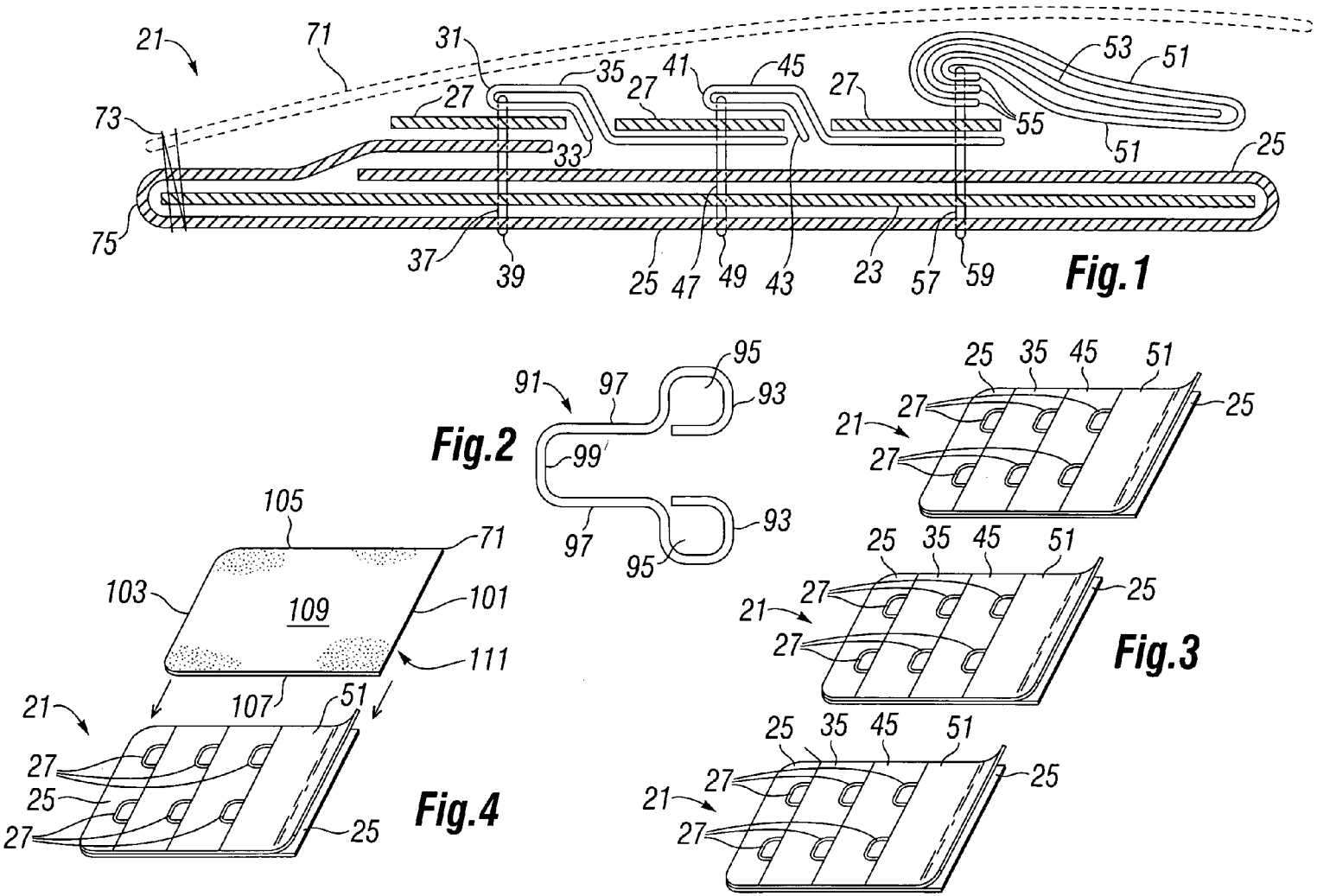
FIG. 1 is a cross sectional view of one possible starting configuration either as a single eye loop tape assembly or a very wide assembly from which eye loop tape assemblies can be cut to form a clothing connector especially for a main bra strap or other clothing structure.
FIG. 2 is a plan view of a eye device seen in side view in FIG. 1.
FIG. 3 is a perspective view of a number of eye loop assemblies which may have been cut from the starting structure of FIG. 1.
FIG. 4 is a perspective view of a single eye loop tape assembly with a reversible covering layer in position for attachment.

Referring to FIG. 1, a side sectional view of a length of a eye loop tape assembly 21 is shown. The actual resulting shape is planar, but the schematic nature of the figure causes it to appear somewhat slanted in height and uneven. There are many alternatives which can be constructed of the eye loop tape assembly 21, and in fact the invention herein very likely opens the door to other constructions of less complicated construction. Assembly 21 includes a central strength layer 23 about which a softer finishing layer 25 extends in an a mutual support fashion. A series of eye loops 27, seen in side view, are attached to the eye loop tape assembly 21 in such a manner that the lower (right hand from the perspective of FIG. 1) portion of the eye loops 27 are covered by layers of material to both cover and protect their points of attachment.

The left-most eye loop 27 is attached using a first covering and fastening layer 31 and includes a first portion 33 which overlies the eye loop 27 and a second portion 35 which extends to underlie the next most adjacent eye loop 27. The covering and fastening layer 31 is positioned over the eye loop 27 and the eye loop 27 is sewn through the openings in the eye loop (to be shown), and through both sides of the softer finishing layer 25 and through the central strength layer 23. The point at which the covering and fastening layer 31 is sewn onto the eye loop 27 sets the lengths of the first and second portions 33 and 35. The idea in choosing the lengths of the first and second portions 33 and 35 is to provide enough of the first portion 33 so that the sewing operation will not occur near the edge, and to provide enough of the first portion 33 to extend underneath the next most adjacent eye loop 27.

The sewn attachment is schematically shown as a stitch 37 which may terminate in a rough end 39. The rough end 39 is not necessarily a pointy end and in terms of user discomfort, such discomfort can come via the type of thread used, whether any loose threads are present, and especially where a random out of place thread is loose or terminates at a sharp point. Polymeric threads can particularly cause problems as they tend to be stiff where loose ends extend from a material from which they are bound. The stitch 37 need not even be a traditional stitch, as it can be innovative artwork, like weldinf. A weld can occur where the materials are melted together either by heat or ultrasonic input accompanied by pressure. The use of the covering and fastening layer 31 helps users try and hook the left exposed side of the eye loop 27 using a compatible hook (not shown) in order to avoid any interference or snagging on the bottom or right hand most structures of the eye loop 27. In this way, any hook which is dragged across the second portion 35 of the first covering and fastening layer 31 would more easily "find" or slip into an opening formed the left side of eye loop 27 rather than any of the structures on the right side of the eye loop 27 or the stitch 37 if it were used to directly engage the eye loop 27. This is especially useful where fastening is to occur when the user cannot directly see the hooks (not shown) and eye loops 27.

It is understood that the eye loops 27 can number more or less than three along the length (width from the perspective of FIG. 1) of any eye loop tape assembly 21 seen. Three eye loops 27 are shown in this embodiment. The middle eye loop 27 is attached using a second covering and fastening layer 41 and includes a first portion 43 which overlies the eye loop 27 and a second portion 45 which extends to underlie the next most adjacent, namely the right-most eye loop 27. The covering and fastening layer 41 is positioned over the middle eye loop 27 and the middle eye loop 27 is sewn through the openings in the eye loop (to be shown) in the same manner as was done for the left-most eye loop 27. A sewn attachment is schematically shown as a stitch 47 which may terminate in a rough end 49.

The right-most eye loop 27 has a different covering and fastening layer. The right-most eye loop 27 is attached using a double covering and fastening and securing layer assembly which includes an outer, relatively softer covering and fastening layer 51 which sandwiches a second central strength layer 53 which may or may not be made from the same material as the central strength layer 23. The covering and fastening and securing layer 51 is so designated because it will act with central strength layer 23 and softer finishing layer 25 to secure the eye loop tape assembly 21 to another structure. It can be seen that the double covering layer assembly, including layers 51 and 53, has ends 55. A stitch 57 attaches the double covering layer assembly spaced slightly apart from the ends 55 sufficient to form a good connection. Note that the main extent of the double covering layer assembly, including layers 51 and 53, were connected in a manner to be directed toward the middle and left most eye loop 27 and then folded over toward the opposite end of the eye loop tape assembly 21. This helps to cover the end of the stitch 57, while the rough end 59 still appears at the bottom of the eye loop tape assembly 21. Further, the double covering layer assembly, including layers 51 and 53, helps to form, with the central strength layer 23 and softer finishing layer 25 a pair of lengths of material which can capture another member between them to form an evenly secured fit.

Also seen in phantom is a reversible roughness insulating roughness insulating covering layer 71 having an attachment point 73. These structures are first introduced in FIG. 1 so that the reader can know where such a layer should extend with regard to the structures seen in FIG. 1. The end of the reversible roughness insulating covering layer 71 can extend to a point short of the end of eye loop tape assembly 21 or fall short of it. The attachment point 73 can be of any type, such as ultrasonic welded, stitched, melted or any other manner of attachment. Further details will be shown from a perspective in which the extent of attachment of the reversible roughness insulating covering layer 71 will be shown. Further, it is preferable that the reversible roughness insulating covering layer 71 be made of material which can soften the presence of underlying structures such as the rough ends 39, 49, and 59. Further, reversible roughness insulating covering layer 71 should have the ability to stretch. As can be seen in FIG. 1, any movement of the reversible roughness insulating covering layer 71 to the other side of the eye loop tape assembly 21 will have to either stretch or have additional material to both cover a terminal edge 75 of the eye loop tape assembly 21.

Referring to FIG. 2, a plan view of an eye loop connector 91 is seen. The eye loop connector 91 is typically made from a small wire that has been cut and bent to a shape similar to that shown. A pair of base eyelets 93 are formed with each having an opening 95 which may or may not be effectively closed depending upon the precision of the machine forming the eye loop connector 91. The use of the eyelets 93 are provided so that any sewing which ventures into those areas will hold the eye loop connector 91 securely. This type of arrangement works well with linear sewing across the bottom of the eye loop connector 91 which is so small and smooth that it can easily deflect the sewing action of any needle directed toward the right hand base.

The eye loop connector 91 also has a pair of arms 97 which terminates at an end bar 99. The end bar 99 is typically compatible with any hook to be used with the eye loop connector 91. Where a hook (not shown) has a pair of evenly spaced members, the straight end bar 99 provides a balanced connection. Further, the arms 97 enable the manufacturer to determine the extent to which the end bar 99 is to extend from the accommodating connection of the eyelets 93.

Referring to FIG. 3, a series of separated eye loop tape assembly 21 are seen. A side sectional view of any of the eye loop tape assemblies 21 would correspond to the side sectional view of FIG. 1, illustrating that it may be preferable to make a laterally extending, very long structure seen into the view of FIG. 1, from which multiple ones of the eye loop tape assemblies 21 can be cut into separate units. The positioning of the eye loop tape assemblies 21 in FIG. 3 illustrates that if the eye loop connectors 27 are appropriately spaced, that a continuous band structure can be made from which the eye loop tape assemblies 21 can be formed automatically.

In FIG. 3, the individual eye loop tape assemblies 21 are formed by cutting, ultrasonic sealing, cutting while sewing, or sewing before or after cutting to name but a few examples. Note also that covering layer 51 which was very strongly reinforced with a central strength layer 53, and the end base made up of the central strength layer 23 covered by the softer finishing layer 25, together form a pair of structures which can surround, clamp and become sewably attached to another structure, such as a bra main strap. In the form seen in FIG. 3, the eye loop tape assemblies 21 could be utilized with clothing, but the rough ends 39, 49 and 59, as well as roughness from any other source on the underside of the eye loop tape assemblies 21 would contact the user.

At the point after the eye loop tape assemblies 21 are formed, is the best place to introduce the attachment of the reversible roughness insulating covering layer 71. Referring to FIG. 4, a eye loop tape assembly 21 is seen underlying a reversible roughness insulating covering layer 71 which is shown as about to be brought down into place over the eye loop tape assembly 21. The shape of the reversible roughness insulating covering layer 71 may generally match the outer peripheral shape of the eye loop tape assembly 21. The reversible roughness insulating covering layer 71 has a first side edge 101, an opposite second side edge 103, and a third side edge 105 and a fourth side edge 107. Also reversible roughness insulating covering layer 71 has a first planar side 109 and a second planar side 111. As can be seen, the second side 111 is about to be placed opposite the side of the eye loop tape assembly 21 with the exposed loops of the eye loop connectors 27. After the folding operation is completed, it is the first side 109 which will be exposed and the first side 109 will lie opposite the rough ends 39, 49 & 59. The second side 111 will then lie outside and facing away from the eye loop tape assembly 21 on the side of eye loop tape assembly 21 opposite the exposed eye loop connectors 27. As a result, where the reversible roughness insulating covering layer 71 is available having a softer side and a more rough or more padded side to accommodate the rough ends 39, 49 & 59, the reversible roughness insulating covering layer 71 should be oriented accordingly. However, many of the reversible roughness insulating covering layers 71 may be expected to have two sides of the same softness and texture.

As has been shown in FIG. 1, the eye loop tape assembly 21, even if made of outwardly soft materials, is somewhat resistant to bending and folding due to its layered nature. The ability of the eye loop tape assembly 21 to form a pocket and then be turned inside out will typically be permissible based upon the ability of the combination of the flexibility of the eye loop tape assembly 21 and the flexibility of reversible roughness insulating covering layer 71 to contort more than the eye loop tape assembly 21. This is stated to emphasize that the points of connection of the reversible roughness insulating covering layer 71 need not include a whole side for attachment, and nor must one side be left un-attached; namely that it is the provision of a break in the periphery of attachment which enables an "inside out" reversal action. In the embodiment shown, it is proposed that side edges 105, 103 and 107 be attached and that side edge 101 be left un-attached until the time that the eye loop tape assembly 21 is attached to some other structure, such as a back wing (not shown). In reality, in order to perform an "inside-out" operation where the reversible roughness insulating covering layer 71 moves to the other side, all that is necessary is a minimum peripheral area of non attachment which will enable the inside portion of the remaining structure to pass from the inside to the outside, and which will allow the external areas to move from the outside to the inside. In the present example, a whole side edge 101 will be left unattached in order to facilitate entry and sewing of the reversible roughness insulating covering layer 71 at the time that another structure is added so that attachment and closure of the non attached side edge 101 can occur at one time.

Figure 5:
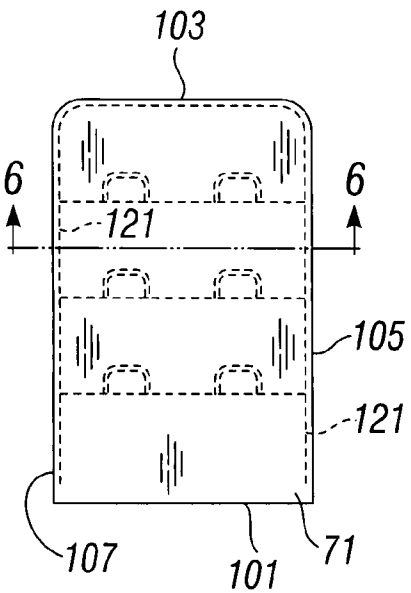
FIG. 5 is a plan view of the eye loop tape assembly with reversible covering layer in place and illustrating a stitch which may be used around three sides to form a pocket structure as a precursor to the inside-out folding.

In terms of exact position of attachment, the more inwardly of the eye loop tape assembly 21 at which reversible roughness insulating covering layer 71 is attached, the more of that side of the eye loop tape assembly 21 will be covered once the inside-out operation is performed. Referring to FIG. 5 a plan view of reversible roughness insulating covering layer 71 lying atop the eye loop tape assembly 21 is shown. Many of the details of the eye loop tape assembly 21 are shown in phantom. However, a stitch line 121 is shown which is slightly inside of the side edges 103, 107, and 109. The location of the stitch line 121, if stitching is used to attach the reversible roughness insulating covering layer 71, should be inboard of the side edges 103, 107, and 103 sufficient to insure that the reversible roughness insulating covering layer 71 will not be disconnected due to fraying of any material at its edge. Of course, the selection of the material can affect the closeness to the side edges 103, 107 and 109 to which stitch line 121 can approach. Where the reversible roughness insulating covering layer 71 is glued, welded, melted or otherwise bonded, the peripheral attachment point can be closer the outer edges of the reversible roughness insulating covering layer 71. Also, side edge 101 is seen as extending somewhat longer than the terminal edge of the eye loop tape assembly 21. This will enable a greater range of options to be had upon final attachment of the eye loop tape assembly 21 to some other structure, and may be accompanied by cutting or welding or melting or simultaneous attachment and removal of a certain length of the reversible roughness insulating covering layer 71 to form a finished appearance. The lower line indicating extension of the covering layer 71 over the end of the central strength layer 23 covered by the softer finishing layer 25 is omitted to prevent confusion with stitch line 121.

Figure 6:
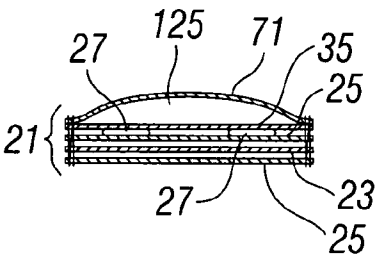
FIG. 6 is a sectional view taken along line 6-6 of FIG. 5 and further illustrating the points of connection of the reversible covering layer and illustrating the formation of a pre-inside-out pocket space over the eye loop side of the eye loop tape assembly.

Referring to FIG. 6, a sectional view taken along line 6-6 of FIG. 5 illustrates the position of the various layers with the reversible roughness insulating covering layer 71 at the top. A pocket space 125 exists between the reversible roughness insulating covering layer 71 and the eye loop tape assembly 21 and can be used to accept insertion of an optional additional roughness insulating member 129. The additional roughness insulating member 129 is shown as having an optional form of attachment. Such attachment may be (1) via extension of the stitch line 121, emphasizing that the insert can be an additional layer of softening material sewably attached, or (2) some other method of attachment, such as by gluing on insertion or, additional additional roughness insulating member 129 can be unattached, and may preferably be oversized to insure that it coverably protects without significantly moving around.

Figure 7:
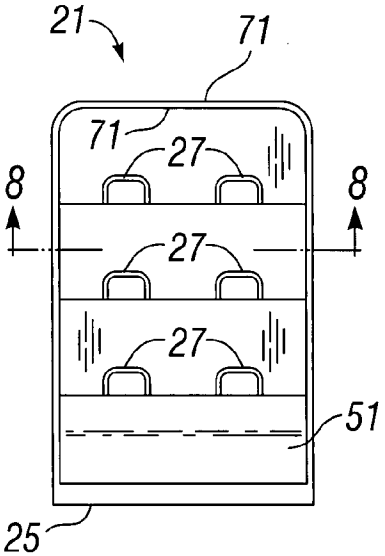
FIG. 7 is a plan view of the eye loop tape assembly after inside-out folding, and with the folded reversible covering layer visible only slightly just inside the periphery of the eye loop tape assembly and covering a portion of the main facing surface in FIG. 7, all the edges and all of the reverse side.

Referring to FIG. 7, a view of the orientation of the eye loop tape assembly 21 similar to that seen in FIG. 5 is seen, but after the inside-out operation has caused the reversible roughness insulating covering layer 71 to become flipped around to cover the back side of the eye loop tape assembly 21. The welding or stitching line 121 will not be directly seen as the most adjacent structure to this is the inner edge of the reversible roughness insulating covering layer 71. As can be seen, a narrow extent of the reversible roughness insulating covering layer 71 can be see just inside the periphery of three sides of the eye loop tape assembly 21. This illustrates that the reversible roughness insulating covering layer 71 extends to cover a portion of the top surface of the eye loop tape assembly 21 on the same side as the exposed eye loop connectors 27, and extending around three edges of the eye loop tape assembly 21 and covering the back surface of the eye loop tape assembly 21 covering the rough ends 39, 49 and 59. The softer finishing layer 25 and covering layer 51 can be seen, and any excess of the reversible roughness insulating covering layer 71 has been trimmed away. Either before the reversible roughness insulating covering layer 71 is trimmed away, it can be seen that the eye loop tape assembly 21 is ready to accept connection to another structure, and that reversible roughness insulating covering layer 71 is in place to protect the user's body. With respect to the orientation of FIG. 7, a male hook member would enter from the top of FIG. 7 and engage the eye loop connectors 27 and thus be held away from the body of the user. As a result a male hook connector would not need any soft layers. The opposite side of eye loop tape assembly 21 than that seen in FIG. 7 would then be the only member resting against the user's body.

Figure 8:
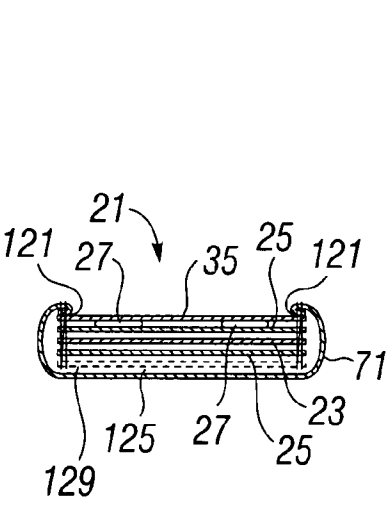
FIG. 8 is a sectional view taken along line 8-8 of FIG. 7 illustrating the eye loop tape assembly after inside-out folding, and identifying the post-inside-out pocket space over the back side the eye loop tape assembly, and into which further softening structure may be inserted prior to attachable sewing.

Referring to FIG. 8, a sectional view taken along line 8-8 of FIG. 7 illustrates the position of the layers after the pocket space 125 moves to the other side of the eye loop tape assembly 21. Further, since the pocket space 125 has been formed while one side edge 101 has remained open, and before any other structure has been attached, the pocket space 125 is temporarily available for the addition of any further insulating inserts, such as a cotton pad, smooth length of plastic or any other structure which will help to increase comfort and attenuate the protrusion of the rough ends 39, 49 and 59. This capability may be even more advantageous when it is considered that the thinner the reversible roughness insulating covering layer 71 is, the more it stretches and the better equipped it will be to perform the inside-out reversal procedure with an eye loop tape assembly 21 which may be more stiff and less foldable or bendable. In this manner, an insert can be quickly and cleanly supplied into the pocket space 125 before attachment of the eye loop tape assembly 21 to another structure such as a bra main strap.

While the present invention has been described in terms of a soft clothing connector which utilizes an inside-out movement of a soft cover to insure that both the surface and side edges of the portion exposed to the consumer's body will be softened, one skilled in the art will realize that the structure and techniques of the present invention can be applied to many clothing appliances and especially appliances which utilize the embodiments of the invention or any process which utilizes the steps of the invention.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A clothing attachment connector with a softening layer reversed from an attachment position to a position to at least partially shield a periphery of the clothing attachment connector comprising:

at least one connection member having a first side having connection structure and a second side, and having at least a pair of oppositely disposed side edges and an end side edge extending between said pair of oppositely disposed side edges;

a soft roughness insulating covering layer which covers the second side of the at least one connection member, the pair of oppositely disposed edges and the end edge and a portion of the first side of the at least one connection member peripherally adjacent and at least partially extending over the pair of oppositely disposed side edges and the end side edge of said connection member to protect a user from contact with at least a pair of oppositely disposed side edges and an end side edge of the connection member.

2. The clothing attachment connector with a softening layer as recited in claim 1 wherein the at least one connection member is an eye loop tape member.

3. The clothing attachment connector with a softening layer as recited in claim 2 wherein the eye loop tape member is rectangular and wherein the soft roughness insulating covering layer is rectangular and where the soft roughness insulating covering layer is attached to the eye loop tape member on three sides.

4. The clothing attachment connector with a softening layer as recited in claim 1 wherein the at least one connection member has a pair of adjacent layers at one end to accept a connection to another clothing structure.

5. The clothing attachment connector with a softening layer as recited in claim 1 wherein the soft roughness insulating covering layer is attached to the at least one connection member first side by stitching.

6. The clothing attachment connector with a softening layer as recited in claim 1 wherein the soft roughness insulating covering layer is attached to the at least one connection member first side by ultrasonic welding.

7. The clothing attachment connector with a softening layer as recited in claim 1 wherein the soft roughness insulating covering layer is attached to the at least one connection member first side by melting.

8. The clothing attachment connector with a softening layer as recited in claim 1 wherein the soft roughness insulating covering layer forms a pocket space with respect to the at least one connection member.

9. An eye loop tape clothing connector with a softening layer comprising:

a clothing connector having an expanse of material having a first side supporting at least one eye loop for connective engagement with a complementary hook member and having a second side;

a soft protrusion insulating roughness insulating covering layer which covers the second side of the clothing connector and at least a portion of a side edge of the clothing connector.

10. The clothing attachment connector with a softening layer as recited in claim 9 wherein the expanse of material includes a central strength layer having a first surface and a second surface surrounded by a softer finishing layer.

11. The clothing attachment connector with a softening layer as recited in claim 10 wherein a second central strength layer is used to secure the at least one eye loop to the expanse of material and is opposite a portion of the expanse of material to enable another clothing structure to be affixed between the second central strength layer and the expanse of material.

12. A process of forming clothing attachment connector with a softening layer reversed from an attachment position with respect to a connection member to a position to at least partially shield a periphery of the connection member comprising the steps of:

providing a connection member having a first side having connection structure and a second side;

attaching a soft roughness insulating covering layer over said first side of said connection member by attaching the soft roughness insulating covering about an attachment portion of a periphery of said at connection member and leaving an unattached portion of a periphery of said connection member;

reversing the connection member and the soft roughness insulating covering layer so that said soft roughness insulating covering layer lies over said second side of said connection member.

13. The process of forming clothing attachment connector with a softening layer reversed from an attachment position with respect to a connection member to a position to at least partially shield a periphery of the connection member as recited in claim 12 and wherein said connection structure is made to be free of contact with said softening layer.

14. The process of forming clothing attachment connector with a softening layer reversed from an attachment position with respect to a connection member to a position to at least partially shield a periphery of the connection member as recited in claim 12 and wherein said formed clothing attachment connector forms a pocket and wherein both said connection member and said softening layer have edges within said pocket.

15. The process of forming clothing attachment connector with a softening layer reversed from an attachment position with respect to a connection member to a position to at least partially shield a periphery of the connection member has a pair of oppositely disposed side edges and wherein said softening layer of material is stretched as it is attached just inward of the outer periphery of the connection member so as to sufficiently to cover a width of said connection member between and over said pair of oppositely disposed side edges.

* * * * *